US012227864B2

(12) United States Patent
Hung et al.

(10) Patent No.: US 12,227,864 B2
(45) Date of Patent: Feb. 18, 2025

(54) ADDITIVE COMPOUND FOR UNIFORM DYEING AFTER ANODIC OXIDATION, ADDITIVE SOLUTION HAVING THE ADDITIVE COMPOUND, AND DYEING METHOD

(71) Applicant: HONGFUJIN PRECISION ELECTRONICS (CHENGDU) Co., Ltd., Chengdu (CN)

(72) Inventors: Chih-Chien Hung, New Taipei (TW); Xiao-Gang Peng, Shenzhen (CN); Jian-Bin Wang, Chengdu (CN); Xing-Liang Zhang, Chengdu (CN); Chao Zhang, Chengdu (CN); Feng Liu, Chengdu (CN); Peng Lan, Chengdu (CN)

(73) Assignee: HONGFUJIN PRECISION ELECTRONICS (CHENGDU) Co., Ltd., Chengdu (CN)

( * ) Notice: Subject to any disclaimer, the term of this patent is extended or adjusted under 35 U.S.C. 154(b) by 128 days.

(21) Appl. No.: 17/830,523

(22) Filed: Jun. 2, 2022

(65) Prior Publication Data

US 2023/0167570 A1 Jun. 1, 2023

(30) Foreign Application Priority Data

Nov. 27, 2021 (CN) ..... 202111426508.4

(51) Int. Cl.
*C25D 11/24* (2006.01)

(52) U.S. Cl.
CPC ..... *C25D 11/24* (2013.01)

(58) Field of Classification Search
CPC ..... C25D 11/04; C25D 11/06; C25D 11/08; C25D 11/10; C25D 11/12; C25D 11/14;
(Continued)

(56) References Cited

U.S. PATENT DOCUMENTS 5,120,405 A 6/1992 Ito et al.
6,797,016 B1 * 9/2004 Schofberger ..... C09B 67/0073 8/522

(Continued)

FOREIGN PATENT DOCUMENTS

CN 104651905 A 5/2015
CN 107815716 A 3/2018

(Continued)

OTHER PUBLICATIONS

JP-2016138331-A specification English (Year: 2016).*
JP-2016138331-A claims English (Year: 2016).*

*Primary Examiner* — Ricardo D Morales
(74) *Attorney, Agent, or Firm* — ScienBiziP, P.C.

(57) ABSTRACT

An additive compound for dyeing an aluminum or aluminum alloy substrate after anodic oxidation to provide better uniformity in dyeing and hence a better finished appearance includes a main agent, an auxiliary agent, a pH stabilizer, and an antibacterial agent. The antibacterial agent includes at least one of sorbic acid, fluconazole, itraconazole, *Artemisia argyi*, benzyl alcohol, benzoic acid, salicylic acid, and boric acid. An additive solution and a dyeing method are also provided, the use of the compound also allows for a more rapid dyeing process.

9 Claims, 4 Drawing Sheets

(58) Field of Classification Search
CPC ..... C25D 11/18; C25D 11/24; C25D 11/243; C25D 11/246
See application file for complete search history.

(56) References Cited

U.S. PATENT DOCUMENTS

| | | | | |
|---|---|---|---|---|
| 2009/0148794 | A1* | 6/2009 | Baumann | G03F 7/322 430/302 |
| 2020/0056300 | A1* | 2/2020 | Curran | H05K 5/0243 |

FOREIGN PATENT DOCUMENTS

| | | | | |
|---|---|---|---|---|
| CN | 110835774 | A | 2/2020 | |
| CN | 113151876 | A | 7/2021 | |
| JP | 2016138331 | A * | 8/2016 | C25D 11/14 |

* cited by examiner

ADDITIVE COMPOUND FOR UNIFORM DYEING AFTER ANODIC OXIDATION, ADDITIVE SOLUTION HAVING THE ADDITIVE COMPOUND, AND DYEING METHOD

FIELD

The subject matter relates to dyeing, and more particularly, to an additive compound used for dyeing after anodic oxidation, an additive solution having the additive compound, and a dyeing method.

BACKGROUND

Large-sized workpieces made of aluminum or aluminum alloy may have thin walls, and the thin walls may have large and complex 3D surfaces. For example, such a workpiece may have a surface greater than or equal to 50 $dm^2$. An anodic oxidation can be performed on the surface of the workpiece to form a porous oxide film. Then, the oxidized workpiece can be immersed in the dyeing solution, causing dyes to diffuse into the pores of the oxide film through diffusion. Thereby, the workpiece obtains a personalized, diverse, and colorful appearance after dyeing.

However, appearance abnormalities such as uneven dyeing, flow marks, and white spots may occur after dyeing. When the thin wall has holes, color difference may also be seen on edges of the holes. Therefore, there is a room for improvement in the art.

BRIEF DESCRIPTION OF THE DRAWINGS

Implementations of the present disclosure will now be described, by way of embodiments only, with reference to the attached figure.

DETAILED DESCRIPTION

Figure 1:
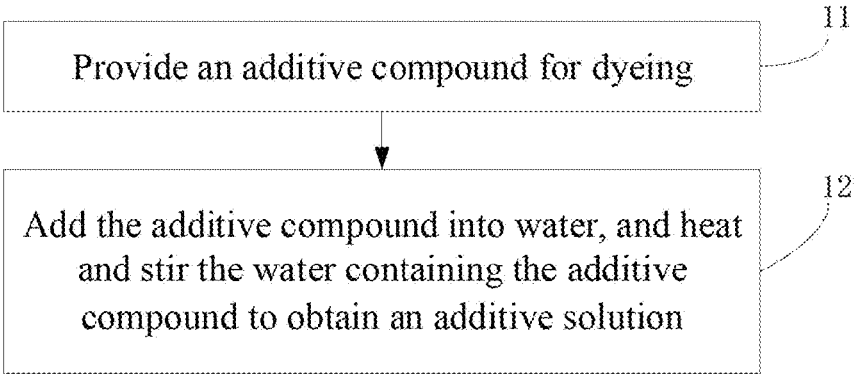
FIG. 1 is a flowchart of a method for preparing an additive solution for dyeing according to an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the comparative examples of certain parts may be exaggerated to better illustrate details and features of the present disclosure.

The term "comprising," when utilized, means "including, but not necessarily limited to"; it specifically indicates open-ended inclusion or membership in the so-described combination, group, series, and the like.

Abnormalities in appearance of anodized articles can occur after dyeing on large-sized workpieces made of aluminum or aluminum alloy and which have thin walls with large and complex 3D surfaces. The reasons may be that, compared to a small-sized workpiece, the large-sized workpiece has a larger area in contact with the dyeing solution during dyeing, and also has a more complex structure. Thus, any shortcomings in a dyeing solution (such as the presence of mildew, of foreign matter or other impurities) will have a greater probability of appearance abnormalities. For example, the foreign matter or impurities of the dyeing solution may be adhering to the surface of the workpiece, which causes a greater probability of uneven dyeing and renders non-uniformity more noticeable.

The present disclosure provides an embodiment of an additive compound for dyeing, which may be added to a dyeing solution including dyes. The additive compound is used to dye an aluminum or aluminum alloy substrate after anodic oxidation. The substrate may have a thin wall, and the thin wall may have a large and complex 3D surface. For example, the substrate may have a surface greater than or equal to 50 $dm^2$. In at least one embodiment, the aluminum alloy mainly comprises Al—Mg alloy. The content of Mg element in the aluminum alloy is 96% to 98%, and the content of Al element in the aluminum alloy is 2% to 4%. The aluminum alloy may be 5 series aluminum alloy, 6 series aluminum alloy, or 7 series aluminum alloy. Grains of the aluminum alloy have an average diameter of 35 μm to 50 μm, and the grain size has a grade of 6.0.

The additive compound includes a main agent, an auxiliary agent, a pH stabilizer, and an antibacterial agent. The antibacterial agent includes at least one of sorbic acid, fluconazole, itraconazole, *Artemisia argyi*, benzyl alcohol, benzoic acid, salicylic acid, and boric acid.

In at least one embodiment, the main agent, the auxiliary agent, the pH stabilizer, and the antibacterial agent are in a mass ratio of (7.5~9):(7~8):(0.8~1.2):(0.03~0.04). For example, the main agent, the auxiliary agent, the pH stabilizer, and the antibacterial agent are in a mass ratio of 7.5:7:0.82:0.03, 7.5:8:1:0.04, 8:7:0.82:0.03, 8:8:1:0.04, 9:7:0.82:0.03, or 9:8:1:0.04.

The main agent disperses dyes evenly in the dyeing solution and works to prevent different colors on the substrate due to uneven dyeing. The main agent includes sulfonate. In at least one embodiment, the main agent includes at least one of methylsulfonic acid, aminosulfonic acid, benzene sulfonic acid, p-toluenesulfonic acid, taurine, mercaptopropane sulfonic acid, trifluoromethane sulfonic acid, naphthalene sulfonic acid, methyl naphthalene sulfonic acid, sodium salt of alkyl sulfonic acid, potassium salt of alkyl sulfonic acid, calcium salt of alkyl sulfonic acid, and magnesium salt of alkyl sulfonic acid.

When the additive compound is added into the dyeing solution including dyes, the auxiliary agent evenly disperses the dyes in the dyeing solution, and promotes the adhesion of the dyes onto the surface of the substrate. The auxiliary agent includes a carboxylate. In at least one embodiment, the auxiliary agent includes at least one of sodium tricarboxylate, potassium tricarboxylate, calcium tricarboxylate, tricarboxylic acid, sodium dicarboxylate, potassium dicarboxylate, calcium dicarboxylate, and magnesium dicarboxylate.

The pH stabilizer stabilizes a pH value of the dyeing solution, and also improves a speed of dyeing even for low concentrations of dyeing solution. Furthermore, the pH stabilizer also prolongs shelf-life of the dyeing solution. The pH stabilizer includes carboxylic acid. In at least one embodiment, the pH stabilizer includes at least one of tricarboxylic acid and dicarboxylic acid.

The antibacterial agent prevents mildew and foaming of the dyeing solution, thereby avoiding an unstable pH value and prolonging the shelf-life of the dyeing solution. The antibacterial agent further avoids an uneven distribution of the dyes in the dyeing solution. The antibacterial agent further prevents biological activity of foreign matter or impurities in adhering onto the surface of the substrate, thereby avoiding an uneven dyeing of the substrate. The antibacterial agent includes at least one of sorbic acid, fluconazole, itraconazole, *Artemisia annua*, benzyl alcohol, benzoic acid, salicylic acid, and boric acid.

In at least one embodiment, the additive compound further includes a moderating agent. In at least one embodiment, the moderating agent is held separately from the main agent, the auxiliary agent, the pH stabilizer, and the antibacterial agent. That is, the main agent, the auxiliary agent, the pH stabilizer, and the antibacterial agent are mixed together, and the moderating agent is stored separately. In other embodiments, the moderating agent is mixed together with the main agent, the auxiliary agent, the pH stabilizer, and the antibacterial agent. The moderating agent slows down the speed of dyeing to avoid the generation of flow marks. The moderating agent includes at least one of sodium sulfate, sodium hydrochloride, sodium nitrate, magnesium sulfate, magnesium hydrochloride, magnesium nitrate, potassium sulfate, potassium hydrochloride, potassium nitrate, calcium sulfate, calcium hydrochloride, and calcium nitrate.

In at least one embodiment, when the moderating agent is mixed together with the main agent, the auxiliary agent, the pH stabilizer, and the antibacterial agent, the moderating agent and the main agent are in a mass ratio of (0.05~0.2):1. For example, the moderating agent and the main agent are in a mass ratio of 0.05:1, 0.1:1, 0.15:1, or 0.2:1.

The present disclosure further includes an embodiment of an additive solution for dyeing. The additive solution includes water and the above-mentioned additive compound. In at least one embodiment, when the additive compound does not include the moderating agent, the main agent, the auxiliary agent, the pH stabilizer, the antibacterial agent, and the water are in a mass ratio of (7.5~9):(7~8):(0.8~1.2):(0.03~0.04):(18~20) in the additive solution. For example, the main agent, the auxiliary agent, the pH stabilizer, the antibacterial agent, and the water are in a mass ratio of 7.5:7:0.82:0.03:18, 7.5:8:1:0.04:20, 8:7:0.82:0.03:18, 8:8:1:0.04:20, 9:7:0.82:0.03:18, or 9:8:1:0.04:20. When the additive compound includes the moderating agent, the main agent, the auxiliary agent, the pH stabilizer, the antibacterial agent, the moderating agent, and the water are in a mass ratio of (7.5~9):(7~8):(0.8~1.2):(0.03~0.04):(0.38~1.8):(18~20) in the additive solution. For example, the main agent, the auxiliary agent, the pH stabilizer, the antibacterial agent, the moderating agent, and the water are in a mass ratio of 7.5:7:0.82:0.03:0.38:18, 7.5:8:1:0.04:1.8:20, 8:7:0.82:0.03:0.38:18, 8:8:1:0.04:1.8:20, 9:7:0.82:0.03:0.38:18, or 9:8:1:0.04:1.8:20.

In at least one embodiment, the water may be deionized water. Conductivity of the deionized water is less than 5 μs/cm, and the pH value of the deionized water is in a range of 6.0 to 7.

To use, the additive solution is added into the dyeing solution when building up a dyeing bath to obtain a dyeing mixture. The additive solution has a concentration of 3 g/L to 10 g/L in the dyeing mixture. More additive solution may also be supplemented into the dyeing solution together with dyes during the dyeing process. The amount of the additive solution being supplemented can be set according to the area of the substrate that needing to be dyed. In at least one embodiment, the amount of the additive solution being supplemented is 0.1 g to 0.2 g per square decimeter. That is, the amount of the additive solution being supplemented is 0.1~0.2 g/dm$^2$, wherein dm$^2$ refers to the area of the substrate needing to be dyed during a single dyeing process.

Furthermore, when the additive compound does not include the moderating agent, the moderating agent may also be separately added into the dyeing solution as needed. For example, when the substrate after dyeing shows flow marks on its surface, the moderating agent can be added. The moderating agent is omitted when it is unnecessary. The moderating agent may be added separately to the additive solution when building up the dyeing bath. The amount of the moderating agent being added is 0.2~2 g/L when building up the dyeing bath. More moderating agent may also be supplemented into the dyeing solution together with the dyes during the dyeing process. In this case, the amount of the moderating agent being supplemented is 0.01~0.03 g/dm$^2$, wherein dm$^2$ refers to the area of the substrate needing to be dyed during a single dyeing process.

After the additive solution is added into the dyeing solution to obtain the dyeing mixture, the pH value of the dyeing mixture is stable, which is in a range of 5.4 to 5.8. The dyes are evenly dispersed in the dyeing mixture. Thus, the substrate will be quickly dyed even when the concentration is low. Specifically, after the additive solution is added into the dyeing solution, the concentration of the dyeing solution is reduced by 20% to 55%, but the dyeing period is shortened by 0.4 to 0.55 times, and the shelf-life is prolonged by 3 to 10 times. Moreover, the dyeing film formed on the substrate is uniform, dense, and strong, and has a better UV resistance.

Referring to FIG. 1, a method for preparing the additive solution is provided by way of example, as there are a variety of ways to carry out the method. Each block shown in the figure represents one or more processes, methods, or subroutines, carried out in the example method. Furthermore, the illustrated order of blocks is illustrative only and the order of the blocks can change. Additional blocks can be added, or fewer blocks may be utilized, or the order of the blocks may be changed, without departing from this disclosure. The method can begin at block 11.

At block 11, an additive compound for dyeing is provided. The additive compound includes a main agent, an auxiliary agent, a pH stabilizer, and an antibacterial agent.

At block 12, the additive compound is added into water, the water containing the additive compound is then heated and stirred to obtain the additive solution for dyeing. In at least one embodiment, the main agent, the auxiliary agent, the pH stabilizer, the antibacterial agent, and the water are in a mass ratio of (7.5~9):(7~8):(0.8~1.2):(0.03~0.04):(18~20) in the additive solution. The heating treatment is 40° C. to 60° C., and the heating period is 4 h to 8 h.

Figure 2:
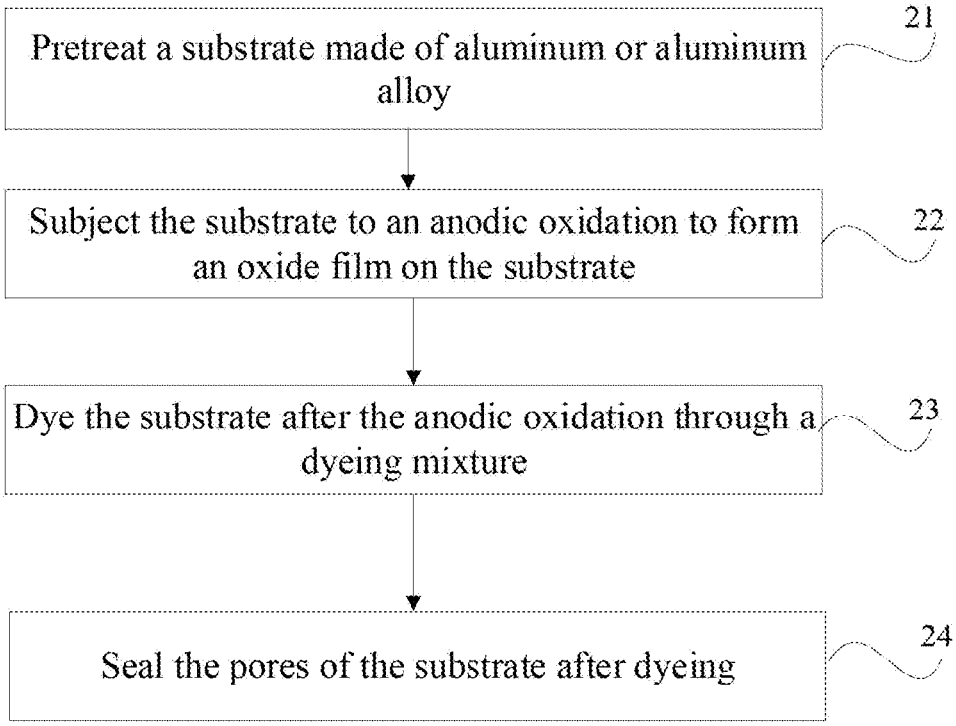
FIG. 2 is a flowchart of a dyeing method according to an embodiment of the present disclosure.

Referring to FIG. 2, a dyeing method is provided by way of example, as there are a variety of ways to carry out the method. Each block shown in the figure represents one or more processes, methods, or subroutines, carried out in the example method. Furthermore, the illustrated order of blocks is illustrative only and the order of the blocks can change. Additional blocks can be added, or fewer blocks may be utilized, or the order of the blocks may be changed, without departing from this disclosure. The method can begin at block 21.

At block 21, the substrate is physically pretreated. The substrate is made of aluminum or aluminum alloy.

In at least one embodiment, the physical pretreatment includes punching, CNC shaping, surface polishing, and sand blasting.

At block 22, the pretreated substrate is anodized (subjected to an anodic oxidation) to form an oxide film on the substrate.

In at least one embodiment, the anodic oxidation may be carried out by placing the pretreated substrate in a degreasing tank containing a degreasing agent, and then a chemical or an ultrasonic degreasing treatment is performed on the substrate. A black film stripping treatment and a chemical polishing treatment are also performed on the degreased substrate. Then, the substrate is placed in an anodic oxidation tank for the anodic oxidation, and the desired oxide film is formed on the substrate.

At block 23, the substrate after the anodic oxidation is dyed by a dyeing mixture. The dyeing mixture includes a dyeing solution and an additive solution. Then, the dyes in the dyeing solution will enter the pores of the oxide film through diffusion. The dyes may also be bonded to the oxide film by covalent bonds or ionic bonds.

In at least one embodiment, the dyeing period is 4 min to 6.5 min. In at least one embodiment, the additive solution has a concentration of 3 g/L to 10 g/L in the dyeing mixture. The additive solution may also be supplemented in an amount of 0.1 to 0.2 g/dm$^2$, wherein dm$^2$ refers to the area of the substrate needing to be dyed during a single dyeing process.

In at least one embodiment, before dyeing, the substrate after the anodic oxidation is first treated by a chemical or mechanical polishing. In another embodiment, the substrate after the anodic oxidation may also be placed into and preheated in a mold. Then, plastic is formed on the substrate by injection molding or hot-pressing molding to obtain a composite substrate. The composite substrate may further be secondary treated by a cutting fluid at any gap between the substrate and the plastic. The secondary treatment includes degreasing, solvent washing, and ultrasonic washing. After the cutting fluid treatment, the composite substrate may further be treated by a nitric acid activation process.

At block 24, the pores of the substrate after dyeing are sealed. As such, the dyes will be secured in the pores and not released. The substrate may also be dried to remove the water, thereby obtaining an article.

Comparative Example 1

Chromium complex dyes (Industrial chemical model: BU30P, manufactured by OKUNO) and a deionized water were mixed to obtain a dyeing solution with a pH value of 5.57, and the chromium complex dyes had a concentration of 2.06 g/L in the dyeing solution. A large-sized aluminum alloy substrate was placed in the dyeing solution for dyeing, and the dyeing period was 9 min. Then, an article was obtained.

The shelf-life of the dying solution of comparative example 1 was only 7 days. Within the shelf-life, the daily pH values of the dying solution (including the production day of the dyeing solution) were tested to be 5.57, 5.69, 5.74, 5.81, 5.96, 6.54, 6.95, and 7.26, respectively. Thus, the pH value of the dyeing solution gradually increases. On the 7$^{th}$ day, the pH value renders the dyeing solution unusable for dyeing the aluminum alloy substrate.

Comparative Example 2

Acid chromium complex dyes including azo groups (Industrial chemical model: BK411, manufactured by OKUNO) and a deionized water were mixed to obtain a dyeing solution with a pH value of 5.54, and the acid azochrome metal composite toner had a concentration of 2.06 g/L in the dyeing solution. A large-sized aluminum alloy substrate was placed in the dyeing solution for dyeing, and the dyeing period was 9.2 min. Then, an article was obtained.

The shelf-life of the dyeing solution in Comparative Example 2 is only 7 days. Within the shelf-life, the daily pH values of the dying solution of comparative example 2 were tested to be 5.56, 5.68, 5.72, 5.8, 5.94, 6.52, 6.91, and 7.25 respectively. Thus, the pH value of the dyeing solution gradually increases. On the 7$^{th}$ day, the pH value makes the dyeing solution unusable.

Example 1

Methyl sulfonic acid, sodium tricarboxylate, tricarboxylic acid, and sorbic acid were added into a deionized water to obtain an additive solution. The methylsulfonic acid, the sodium tricarboxylate, the tricarboxylic acid, the sorbic acid, and the deionized water were in a mass ratio of 7.5:7:0.8:0.03:18~20. A dyeing solution composed of chromium complex dyes (Industrial chemical model: BU30P, manufactured by OKUNO) and a deionized water was provided. The chromium complex dyes had a concentration of 1.48 g/L in the dyeing solution. The additive solution was added to the dyeing solution to obtain a dyeing mixture. The pH value of the dyeing mixture was 5.6, and the additive solution had a concentration of 7.5 g/L in the dyeing mixture. A large-sized aluminum alloy substrate was placed in the dyeing mixture for dyeing, and the dyeing period was 4.5 min. Then, an article was obtained.

The shelf-life of the dyeing mixture in example 1 was 34 days. During the shelf-life, the pH value of the dyeing mixture was maintained between 5.54 and 5.64. On the 34$^{th}$ day, the pH value of the dyeing mixture was 5.62. Thus, the additive solution stabilizes the pH value of the dyeing mixture.

In addition, compared with comparative example 1, when the dyeing solution of example 1 was used to dye the large-sized aluminum alloy substrate, the amount of chromium complex dyes consumed by each substrate was reduced by more than 50%, and the dyeing period was shortened by 25%.

Figure 3:
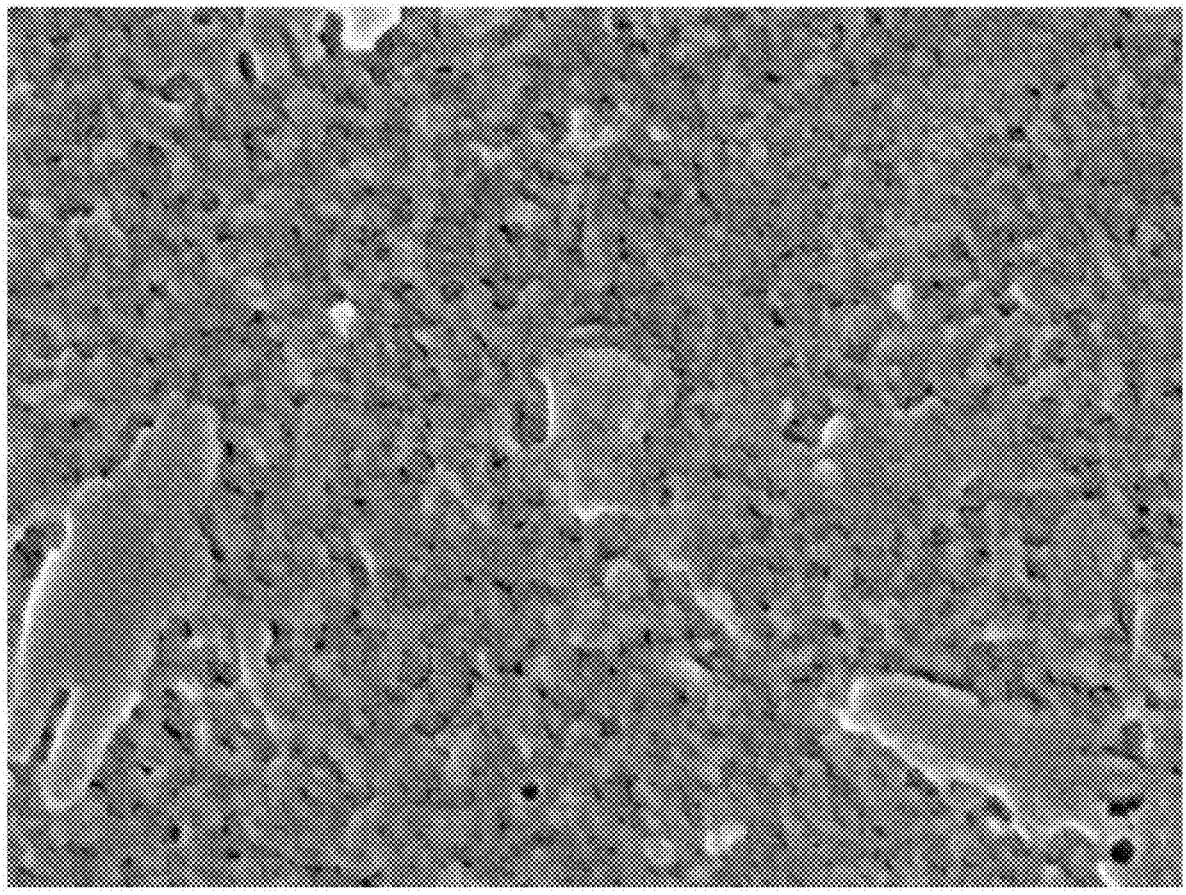
FIG. 3 is a scanning electron microscope (SEM) of an aluminum alloy article prepared by example 1 of the present disclosure.
Figure 4:
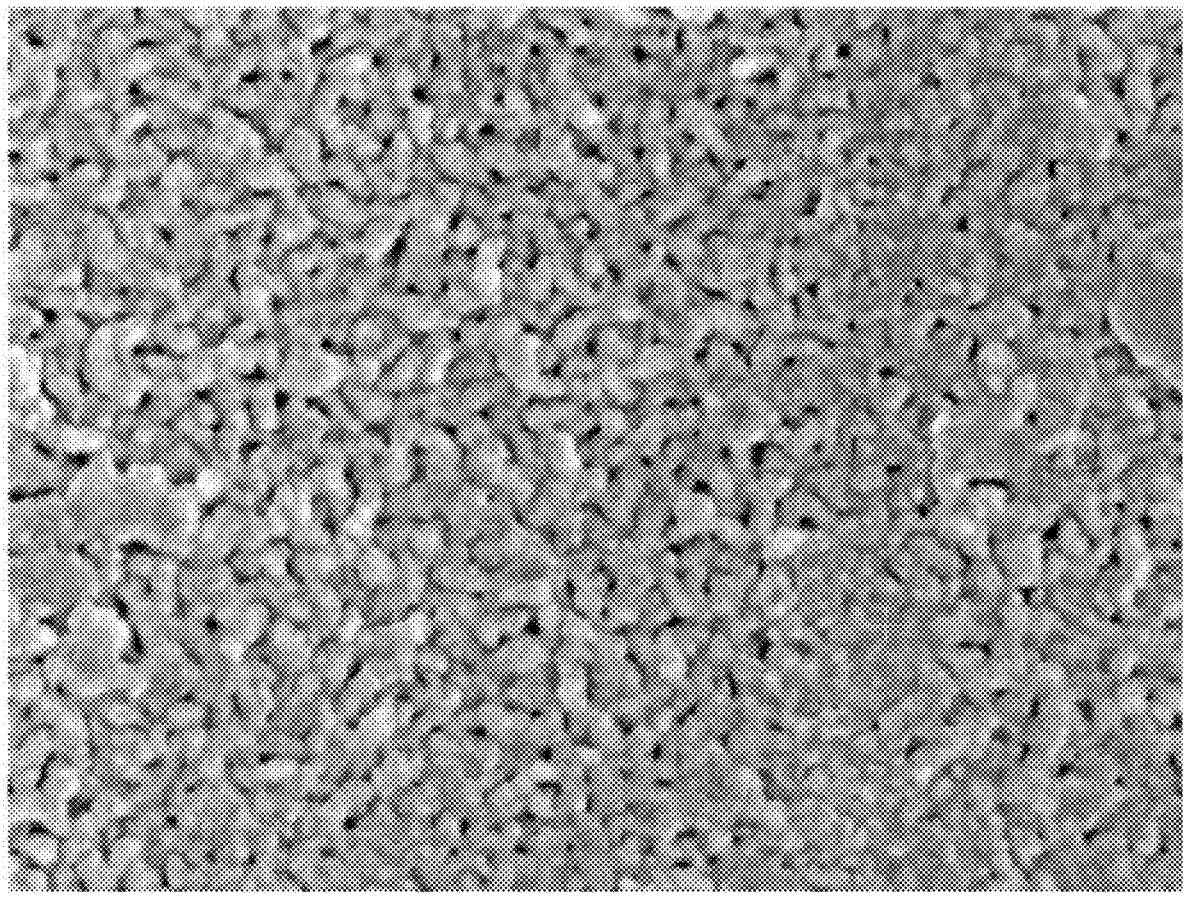
FIG. 4 is an SEM of an aluminum alloy article prepared by comparative example 1 of the present disclosure.

Referring to FIGS. 3 and 4, compared to the article of comparative example 1, the dyes on the article of embodiment 1 were evenly distributed for a uniform appearance.

Example 2

Different from example 1, the methylsulfonic acid, the sodium tricarboxylate, the tricarboxylic acid, the sorbic acid, and the deionized water were in a mass ratio of 7.5:7:0.8:0.035:18~20. The pH value of the dyeing mixture was 5.5, and the additive solution had a concentration of 8 g/L in the dyeing mixture. A large-sized aluminum alloy substrate was placed in the dyeing mixture for dyeing, and the dyeing period was 4.3 min. Then, an article was obtained.

The shelf-life of the dyeing mixture in example 2 is 35 days. During the shelf-life, the pH value of the dyeing mixture was maintained between 5.5 and 5.6. On the 35$^{th}$ day, the pH value of the dyeing mixture was 5.52. Thus, the additive solution stabilizes the pH value of the dyeing mixture.

Example 3

Methyl sulfonic acid, sodium tricarboxylate, tricarboxylic acid, and sorbic acid were added into a deionized water to obtain an additive solution. The sodium tricarboxylate, the tricarboxylic acid, the sorbic acid, and the deionized water were in a mass ratio of 7.5:7:0.8:0.04:18~20. A dyeing solution composed of acid chromium complex dyes including azo groups (Industrial chemical model: BK411, manufactured by OKUNO) and a deionized water was provided. The acid chromium complex dyes had a concentration of 1.4 g/L in the dyeing solution. The additive solution was added to the dyeing solution to obtain a dyeing mixture. The pH value of the dyeing mixture was 5.4, and the additive solution had a concentration of 9 g/L in the dyeing mixture. A large-sized aluminum alloy substrate was placed in the dyeing mixture for dyeing, and the dyeing period was 4.2 min. Then, an article was obtained.

The shelf-life of the dyeing mixture in example 3 was 36 days. During the shelf-life, the pH value of the dyeing mixture of example 3 was maintained between 5.4 and 5.6. On the 36$^{th}$ day, the pH value of the dyeing mixture was 5.5. Thus, the additive solution stabilizes the pH value of the dyeing mixture.

The UV resistance of the articles made by examples 1 to 3 and comparative example 1 was further tested by a UV illumination device, with illumination periods of 100 hours, 200 hours, and 300 hours. The chromaticity (LAB values) of each article after the UV illumination was tested, to determine effects of the UV radiation on the chromaticity of the article. A small chromatic aberration (DE94) indicates a good UV resistance, a large chromatic aberration indicates a poor UV resistance. The results are shown in Table 1.

TABLE 1

| Period/h | Chromaticity | Example 1 | Example 2 | Example 3 | Comparative example 1 |
|---|---|---|---|---|---|
| 0 | L | 53.02 | 52.1 | 50.72 | 52.65 |
| | A | −0.01 | −0.03 | 0.01 | 0.06 |
| | B | −2.6 | −2.74 | −2.37 | −2.08 |
| 100 | L | 53.44 | 52.81 | 51.21 | 54.75 |
| | A | −0.24 | −0.31 | −0.17 | −0.07 |
| | B | −2.38 | −2.47 | −2.13 | −2.36 |
| | DE94 | 0.36 | 0.5 | 0.37 | 1.09 |
| 200 | L | 53.89 | 53.32 | 51.67 | 56.21 |
| | A | −0.38 | −0.44 | −0.3 | −0.59 |
| | B | −2.48 | −2.54 | −2.2 | −2.65 |
| | DE94 | 0.57 | 0.75 | 0.58 | 1.96 |
| 300 | L | 54.29 | 53.64 | 52.02 | 58.26 |
| | A | −0.48 | −0.55 | −0.39 | −0.89 |
| | B | −2.47 | −2.52 | −2.17 | −2.95 |
| | DE94 | 0.79 | 1.02 | 0.78 | 3.05 |

Table 1 shows that, after UV illumination for 300 h, the chromatic aberration of the article of comparative example 1 is greater than 3, which indicates a poor UV resistance. The articles of examples 1 to 3 have better UV resistance.

13915 large-sized aluminum alloy substrates were dyed with the dyeing solution of comparative example 1, and 12565 satisfactory articles were obtained. Thus, the yield was 90.30%. In the defective articles, the articles that generate blank marks account for 0.06%, the articles that generate bank lines account for 0.93%, the articles that generate knife marks account for 0.04%, the articles that show grinding marks account for 0.11%, the articles that show acid droppings account for 0.22%, the articles that show gas marks account for 0.01%, the articles that show flow marks account for 2.15%, the articles that show electric cokes account for 0.09%, the articles that show uneven dyeing account for 2.01%, the articles that show DDS account for 0.57%, the articles that show sandwich lines account for 0.07%, and the articles that show white spots account for 1.56%.

27365 large-sized aluminum alloy substrates were dyed with the dyeing mixture of example 1, and 25559 satisfactory articles were obtained. Thus, the yield was 93.40%. In the defective articles, the articles that show blank marks account for 0.04%, the articles that show bank lines account for is 0.83%, the articles that show knife marks account for 0.01%, the articles that show grinding marks account for 0.12%, the articles that show acid droppings account for 0.32%, the articles that show gas marks account for 0.53%, the articles that show flow marks account for 0.06%, the articles that show electric cokes account for 0.06%, the articles that show uneven dyeing account for 0.33%, the articles that show DDS account for 0.69%, the articles that show sandwich lines account for 0.08%, and the articles that show white spots account for 1.32%.

16578 large-sized aluminum alloy substrates were dyed with the dyeing solution of comparative example 2, and 14904 satisfactory articles were obtained. Thus, the yield was 89.90%. In the defective articles, the articles that show blank marks account for 0.01%, the articles that show bank lines account for 0.93%, the articles that show different colors account for 0.28%, the articles that show knife lines account for 0.86%, the articles that show grinding marks account for 0.95%, the articles that show acid dropping account for 0.26%, the articles that show flow marks account for 2.36%, the articles that show electric cokes account for 0.65%, the articles that show uneven dyeing account for 2.98%, the articles that show DDS account for 1.26%, the articles that show sandwich lines account for 0.01%, and the articles that show white spots account for 1.36%.

32164 large-sized aluminum alloy substrates were dyed with the dyeing mixture of example 3, and 29826 satisfactory articles were obtained. Thus, the yield was 92.70%. In the defective articles, the articles that show blank marks accounts 0.03%, the articles that show bank lines account for 0.89%, the articles that show different colors account for 0.36%, the articles that show knife marks account for 0.591%, the articles that show grinding marks account for 0.89%, the articles that show acid droppings account for 0.29%, the articles that show gas marks account for 0.0.1%, the articles that show flow marks account for 0.56%, the articles that show electric cokes account for 0.72%, the articles that show uneven dyeing account for 0.86%, the articles that show DDS account for 1.39%, the articles that show sandwich lines account for 0.04%, and the articles that show white spots account for 1.39%.

The large-sized aluminum alloy substrates each with an area of 50 dm$^2$ were respectively dyed with the dyeing solution of comparative example 1 (including 30 kg of chromium complex dyes, BU30P) and the dyeing mixture of example 1 (including 30 kg of chromium complex dyes BU30P and 60 kg of additive compound). The shelf-life of the dyeing solution of comparative example 1 is 4 days, which can be used to dye only 2107 substrates. The dyeing period of each substrate was 8 min, the chromium complex dyes consumed by each substrate was 12 g, and the cost for dyeing each substrate was 13.756 yuan. The shelf-life of the dyeing solution in example 1 was 12 days, which can be used to dye 9600 substrates. The dyeing period of each substrate was 6 min, the chromium complex dyes consumed by each substrate was 2.3 g, the additive compound consumed by each substrate was 6.8 g, and the cost for dyeing each substrate was 0.8333 yuan.

The large-sized aluminum alloy substrates each with an area of 50 $dm^2$ were respectively dyed with the dyeing solution of comparative example 2 (including 25 kg of acid chromium complex dyes including azo groups, BK411) and the dyeing mixture of example 3 (including 25 kg of acid chromium complex dyes including azo groups, BK411, and 55 kg of additive compound). The shelf-life of the dyeing solution in comparative example 2 was 5 days, which can be used to dye only 1599 substrates. The dyeing period of each substrate was 8 min, the chromium complex dyes consumed by each substrate was 13 g, and the cost for dyeing each substrate was 14.82 yuan. The shelf-life of the dyeing solution in example 3 was 14 days, which can be used to dye 14240 substrates. The dyeing period of each substrate was 6 min, the chromium complex dyes consumed by each substrate was 1.9 g, the additive compound consumed by each substrate was 6.1 g, and the cost for dyeing each substrate was 0.562 yuan.

Therefore, compared with the dyeing solution of comparative example 2, when the dyeing solution of embodiment 3 is used to dye the substrate, the amount of the chromium complex dyes consumed by each substrate was reduced by more than 50%, and the dyeing period was shortened by 25%.

The above descriptions are some specific embodiments of the present application, but the actual application process cannot be limited to only these embodiments. For those of ordinary skill in the art, other modifications and changes made according to the technical concept of the present application should all belong within the protection scope of the present application.

What is claimed is:

1. An additive compound for dyeing, comprising:

a main agent, an auxiliary agent, a pH stabilizer, an antibacterial agent, and a moderating agent;

wherein the main agent comprises at least one of naphthalene sulfonic acid and methyl naphthalene sulfonic acid; the antibacterial agent comprises at least one of sorbic acid, fluconazole, itraconazole, *Artemisia argyi*, benzyl alcohol, salicylic acid, and boric acid; the moderating agent comprises at least one of sodium sulfate, sodium hydrochloride, sodium nitrate, magnesium sulfate, magnesium hydrochloride, magnesium nitrate, potassium sulfate, potassium salt, potassium nitrate, calcium sulfate, calcium hydrochloride, and calcium nitrate;

wherein the moderating agent is held separately from the main agent, the auxiliary agent, the pH stabilizer, and the antibacterial agent.

2. The additive compound according to claim 1, wherein a mass ratio of the main agent, the auxiliary agent, the pH stabilizer, and the antibacterial agent are in a range of (7.5-9):(7-8):(0.8-1.2):(0.03-0.04).

3. The additive compound according to claim 1, wherein the auxiliary agent comprises carboxylate.

4. The additive compound according to claim 1, wherein the pH stabilizer comprises carboxylic acid.

5. The additive compound according to claim 1, wherein a mass ration of the moderating agent and the main agent are in a range of (0.05-0.2):1.

6. An additive solution for dyeing, comprising:

water; and an additive compound comprising a main agent, an auxiliary agent, a pH stabilizer, an antibacterial agent, and a moderating agent, wherein the main agent comprises at least one of naphthalene sulfonic acid and methyl naphthalene sulfonic acid; the antibacterial agent comprises at least one of sorbic acid, fluconazole, itraconazole, *Artemisia argyi*, benzyl alcohol, salicylic acid, and boric acid; the moderating agent comprises at least one of sodium sulfate, sodium hydrochloride, sodium nitrate, magnesium sulfate, magnesium hydrochloride, magnesium nitrate, potassium sulfate, potassium salt, potassium nitrate, calcium sulfate, calcium hydrochloride, and calcium nitrate;

wherein the moderating agent is held separately from the main agent, the auxiliary agent, the pH stabilizer, and the antibacterial agent; a mass ratio of the main agent, the auxiliary agent, the pH stabilizer, the antibacterial agent, and the water are in a range of (7.5-9):(7-8):(0.8-1.2):(0.03-0.04):(18-20).

7. The additive solution according to claim 6, wherein the auxiliary agent comprises carboxylate.

8. The additive solution according to claim 6, wherein the pH stabilizer comprises carboxylic acid.

9. The additive according to claim 6, wherein a mass ratio of the moderating agent and the main agent are in a range of (0.05-0.2):1.

* * * * *